US012449211B2

(12) United States Patent
Duerr et al.

(10) Patent No.: US 12,449,211 B2
(45) Date of Patent: Oct. 21, 2025

(54) COLLECTING TANK FOR A HEAT EXCHANGER

(71) Applicant: MAHLE International GmbH, Stuttgart (DE)

(72) Inventors: Gottfried Duerr, Ludwigsburg (DE); Uwe Foerster, Erdmannhausen (DE); Stephanie Hahnenkamm, Lorch (DE); Hagen Schirnig, Stuttgart (DE); Martin Sievers, Kernen im Remstel (DE)

(73) Assignee: Mahle International GmbH (DE)

( * ) Notice: Subject to any disclaimer, the term of this patent is extended or adjusted under 35 U.S.C. 154(b) by 196 days.

(21) Appl. No.: 18/115,740

(22) Filed: Feb. 28, 2023

(65) Prior Publication Data

US 2023/0280111 A1 Sep. 7, 2023

(30) Foreign Application Priority Data

Mar. 1, 2022 (DE) ..... 10 2022 202 080.4

(51) Int. Cl.
*F28F 9/02* (2006.01)
*F28D 1/053* (2006.01)
*F28D 21/00* (2006.01)

(52) U.S. Cl.
CPC ..... *F28F 9/02* (2013.01); *F28D 1/05391* (2013.01); *F28D 2021/008* (2013.01); *F28F 2009/0285* (2013.01)

(58) Field of Classification Search
CPC .... F28F 9/02; F28F 9/0224; F28F 9/18; F28F 2009/0292; F28F 2225/08;
(Continued)

(56) References Cited

U.S. PATENT DOCUMENTS 5,676,200 A 10/1997 Laveran
8,662,148 B2 3/2014 Wand
(Continued)

FOREIGN PATENT DOCUMENTS

CN 102099651 A 6/2011
CN 102439380 A 5/2012
(Continued)

OTHER PUBLICATIONS

Chinese Office Action and Search Report, CN202310177993.9, dated May 1, 2025 (w_translation).

*Primary Examiner* — Harry E Arant
(74) *Attorney, Agent, or Firm* — Fishman Stewart PLLC

(57) ABSTRACT

A collecting tank for a heat exchanger may include at least one manifold for receiving a plurality of heat exchanger tubes of the heat exchanger. The at least one manifold may have a hollow space through which a fluid is flowable. The at least one manifold may include a bottom and a plurality of tank receptacles for receiving the plurality of heat exchanger tubes. The plurality of tank receptacles may be disposed in the bottom spaced apart from one another in a longitudinal direction and may extend in a transverse direction, which extends transverse to the longitudinal direction. In a height direction extending transverse to the longitudinal direction and transverse to the transverse direction, directed away from the hollow space, the bottom may have at least one curvature directed to an outside.

20 Claims, 6 Drawing Sheets

(58) Field of Classification Search
CPC ..... F28F 2009/0285; F28D 1/053; F28D 1/05391; F28D 2021/0084; F28D 2021/008; F25B 39/04
See application file for complete search history.

(56) References Cited

U.S. PATENT DOCUMENTS

| | | | | |
|---|---|---|---|---|
| 10,288,331 | B2 | 5/2019 | Taras | |
| 10,767,937 | B2 | 9/2020 | Taras | |
| 10,837,707 | B2 | 11/2020 | Hakamata | |
| 2011/0056667 | A1 | 3/2011 | Taras | |
| 2014/0262181 | A1* | 9/2014 | Taras | F28F 1/10 29/890.047 |
| 2015/0168071 | A1 | 6/2015 | Gao | |
| 2019/0120569 | A1* | 4/2019 | Dolderer | F28F 9/0229 |
| 2021/0131736 | A1 | 5/2021 | Joardar | |

FOREIGN PATENT DOCUMENTS

| | | | | |
|---|---|---|---|---|
| CN | 103890532 | A | 6/2014 | |
| CN | 106574808 | A | 4/2017 | |
| DE | 1961218 | A | 7/1970 | |
| EP | 0406774 | A1 | 1/1991 | |
| EP | 2096398 | A1 * | 9/2009 | F28F 9/02 |
| EP | 2884209 | A1 | 6/2015 | |
| GB | 1297968 | A | 11/1972 | |
| GB | 9928207 | | 1/2000 | |
| GB | 2356923 | A | 6/2001 | |
| JP | 2000213889 | A | 8/2000 | |
| WO | 2012041441 | A2 | 4/2012 | |
| WO | 2014013725 | A1 | 1/2014 | |

* cited by examiner

COLLECTING TANK FOR A HEAT EXCHANGER

CROSS-REFERENCE TO RELATED APPLICATIONS

This application claims priority to German Patent Application No. DE 10 2022 202 080.4, filed on Mar. 1, 2022, the contents of which is hereby incorporated by reference in its entirety.

TECHNICAL FIELD

The present invention relates to a collecting tank for a heat exchanger, in particular for a heat pump heater. The invention furthermore relates to a heat exchanger comprising such a collecting tank, an air-conditioning system comprising such a heat exchanger, as well as a motor vehicle comprising such an air-conditioning system.

BACKGROUND

In a heat exchanger, heat is transferred between two fluids during operation. One of these fluids usually flows via a collecting tank through heat exchanger tubes of the heat exchanger. The other fluid additionally flows around the heat exchanger tubes, thus resulting in a fluidically separated heat transfer between the fluids in a possible operating state. This generally leads to a phase change of the fluid, which flows through the collecting tank and the heat exchanger tubes. This can in particular lead to a condensation of the fluid, which can be, for example, a refrigerant. It is also conceivable to operate heat exchangers of this type in operating modes, in which only one of the fluids flows through the heat exchanger, whereby no or at least a reduced heat transfer results in the heat exchanger in these operating modes.

Such a heat exchanger is known from WO 2012/041441 A2. The collecting tank thereby has at least one manifold comprising a hollow space, which can be flown through. The manifold has a bottom, by means of which the heat exchanger tubes of the heat exchanger are fluidically connected to the hollow space. For this purpose, the bottom has corresponding receptacles for the heat exchanger tubes.

SUMMARY

The present invention deals with the object of specifying improved or at least other embodiments for a collecting tank of the above-mentioned type, for a heat exchanger comprising such a collecting tank, for an air-conditioning system comprising such a heat exchanger, as well as for a motor vehicle comprising such an air-conditioning system, which in particular eliminate disadvantages of solutions known from the prior art. The present invention in particular deals with the object of specifying embodiments for the collecting tank, the heat exchanger, the air-conditioning system, as well as the motor vehicle, which are characterized by an increased stability.

This object is solved according to the invention by means of the subject matter of the independent claim(s). Advantageous embodiments are the subject matter of the dependent claim(s).

The present invention is based on the general idea of providing a bottom of a collecting tank for a heat exchanger, which has receptacles for tube bodies of the heat exchanger, with at least one curvature, which is directed to the outside. The at least one curvature leads to a tension in the collecting tank, in particular in the bottom. This results in an increased mechanical stability of the collecting tank, in particular of the bottom, compared to forces acting from the inside to the outside. In this way, the collecting tank thus has an increased pressure resistance. A corresponding heat exchanger thus also has an increased pressure resistance and thus an improved mechanical stability. The at least one curvature and the reduced tension on the bottom attained therewith further result in that tube bodies of the heat exchanger, which are received in the bottom, are subjected to a reduced mechanical stress.

In accordance with the idea of the invention, the collecting tank has at least one manifold for receiving tube bodies of the heat exchanger. The tube bodies will also be referred to hereinafter as heat exchanger tubes. The respective manifold thereby has a hollow space, which can be flown through and which is limited in the collecting tank. The respective manifold has a bottom. Receptacles, which are spaced apart from one another in one direction, for heat exchanger tubes of the heat exchanger are formed in the bottom. This direction will also be referred to hereinafter as longitudinal direction. The receptacles will also be referred to hereinafter as tank receptacles. The tank receptacles extend in a direction, which runs transverse to the longitudinal direction and which will also be referred to hereinafter as transverse direction. In a direction, which runs transverse to the longitudinal direction and transverse to the transverse direction and which will also be referred to hereinafter as height direction, the bottom thereby has at least one curvature, which is directed away from the hollow space and thus to the outside.

The collecting tank is used in a heat exchanger and serves the purpose of collecting and/or distributing a fluid, which flows through the heat exchanger tubes during operation. The heat exchanger can have two such collecting tanks, which are arranged opposite one another in the height direction. The bottoms of the collecting tanks thereby face one another in the height direction.

The fluid, which flows through the heat exchanger tubes during operation, can flow through the hollow space of the respective manifold. This means that a flow path of the fluid leads through the hollow space of the respective manifold. The fluid is in particular a refrigerant. The flow path will thereby also be referred to in general hereinafter as refrigerant path.

A flow cross section of the respective manifold is advantageously limited or formed, respectively, by the bottom and a wall of the manifold, which adjoins the bottom.

The wall preferably has a circle portion in the shape of a segment of a circle located opposite the corresponding bottom, and transition portions, which adjoin on both sides and which transition into the bottom. The respective transition portion is preferably molded and formed in such a way that the circle portion, together with the transition portions, limits or defines an a-shaped flow cross section or a flow cross section close thereto, respectively. This in particular makes it possible to realize the fluidic supply of the manifold with reduced pressure losses.

At least one of the at least one curvatures, preferably the respective curvature, advantageously extends longitudinally in the transverse direction. At least one of the at least one curvatures, preferably the respective curvature, preferably extends parallel to the tank receptacles.

In the transverse direction, the respective tank receptacle extends over a width, which will also be referred to hereinafter as receiving width.

In the height direction, the respective curvature extends over a height, which will also be referred to hereinafter as curvature height. The curvature height thereby extends between the point of the curvature, which protrudes maximally in the height direction, and the point, which is nearest adjacent in the height direction of the curvature and in the case of which the corresponding manifold has a maximum manifold width in the transverse direction. This thus means that, in particular in the height direction, the curvature height extends between the transition of the wall into the bottom and the point of the bottom maximally protruding in the height direction. The curvature height thereby preferably extends between the outer sides of the manifold facing away from the corresponding hollow space.

Embodiments, in the case of which the ratio between at least one of the at least one curvature heights and at least one of the receiving widths of at least one of the at least one manifolds is between 0.05 and 1.5, are considered to be advantageous. The ratio between the respective curvature height and the respective receiving width is preferably between 0.05 and 1.5. This leads to an advantageous mechanical stabilization, in particular pressure resistance, of the manifold with simultaneously compact formation and/or reduced penetration depth of the corresponding heat exchanger tubes into the manifold.

Particularly preferably, the ratio between at least one of the at least one curvature heights and at least one of the receiving widths of at least one of the at least one manifolds, in particular of the respective curvature height and the respective receiving width, is between 0.10 and 0.5. This means that the curvature height corresponds to between 10% and 50% of the receiving width. Complex and time-consuming studies and optimizations have led to the surprising result that such a ratio between the curvature height and the receiving width leads to a particularly increased stability, in particular pressure resistance, of the manifold with simultaneously reduced installation space requirement and low penetration depth of the heat exchanger tubes.

Embodiments, in the case of which the receiving width extends between inner sides of the tank receptacle facing one another in the transverse direction, are considered to be advantageous. This means that the receiving width runs from the one to the other inner side. The receiving width thus at least essentially corresponds to a width, which runs in the transverse direction, of the heat exchanger tube received in the tank receptacle. As a result, the force, which is transferred to the heat exchanger tube, and thus the mechanical stress on the heat exchanger tube, is decreased by means of the tension, which acts in a reduced manner in the region of the tank receptacle. The result is an increased service life of the heat exchanger. In this way, the respective heat exchanger tube can additionally be produced in a more thin-walled manner and thus more cost-efficiently and with reduced weight.

In general, the bottom can fully have such a curvature. This means that the entire bottom can be curved to the outside accordingly.

The bottom as a whole is preferably curved to the outside in the height direction and additionally has at least one such curvature. This means that the bottom has a convex basic shape, which is curved to the outside and into which at least one such curvature is introduced additionally and locally. This leads to a particularly increased pressure resistance and thus mechanical stability. The bottom advantageously has two such curvatures, which are spaced apart from one another in the longitudinal direction. The respective curvature thereby preferably extends over the entire bottom in the transverse direction.

Between at least two consecutive tank receptacles, the bottom preferably has one such curvature. It is conceivable in particular that the bottom has one such curvature between respective consecutive tank receptacles, so that tank receptacles and curvatures alternately follow one another in the longitudinal direction. This leads to a particularly pronounced pressure resistance of the collecting tank.

The collecting tank can have a single one such manifold.

It is also conceivable that the collecting tank has two or more manifolds, which are adjacent in the transverse direction. It is preferred thereby when the bottom of the respective manifold has at least one such curvature.

On principle, the manifolds of the collecting tank can be produced separately and can subsequently be attached to one another, in particular connected to one another.

The manifolds of the collecting tank are preferably integral. The manifolds are thus made monolithically or jointly of the same base material, respectively. The manifolds can in particular be made of a sheet metal part, for example by forming the sheet metal part. The manifolds are thus in particular made of the same sheet metal part, which is processed, in particular deformed, for producing the manifolds, and which is provided with the collecting tank receptacles.

At least one of the manifolds, preferably the respective manifold, is advantageously closed in the longitudinal direction, so that the hollow space in the manifold is limited in the longitudinal direction. For this purpose, the collecting tank can have, for example, at least one end plate, which is attached to the manifold.

For the fluidic supply, the collecting tank can have at least one fluidic connection. The refrigerant path thus leads through the respective fluidic connection.

It is conceivable thereby that at least one of the at least one fluidic connections is formed in the bottom of at least one of the manifolds. It is preferred thereby when at least one such curvature is arranged between the connection and the tank receptacle, which is nearest adjacent in the longitudinal direction.

The respective tank receptacle can be formed in any way, in particular introduced into the corresponding bottom.

Embodiments, in the case of which the tank receptacles of at least one of the at least one manifolds, advantageously of the respective manifold, are formed by means of passages, which are directed away from the corresponding hollow space, are advantageous.

It goes without saying that, in addition to the collecting tank, the heat exchanger comprising the collecting tank as such also belongs to the scope of this invention.

The refrigerant path thereby leads through the collecting tank and through the heat exchanger tubes. A flow path of a fluid further leads between the heat exchanger tubes and fluidically separated from the refrigerant path. Advantageously, the fluid is a gas, in particular air. The flow path will also be referred to hereinafter as gas path. A heat transfer between the refrigerant and the gas thus takes place during operation.

The heat exchanger is in particular designed as a condenser, so that the refrigerant condenses in the heat exchanger during operation. The heat exchanger is in particular designed as a heat pump heater. A heat transfer from the refrigerant to the gas thereby takes place during operation, so that the gas absorbs heat, and the refrigerant emits heat and cools down or condenses. A saturation pressure above the desired gas outlet temperature is necessary in order to condense the refrigerant. Increased pressures thus result in the heat exchanger, in particular in the collecting tank and in the heat exchanger tubes, during operation. The collecting tank according to the invention is thus particularly well suited for a heat exchanger, in which the fluid, which flows through the heat exchanger tubes and the collecting tank during operation, condenses, thus in particular for a condenser and/or a heat pump heater.

The heat exchanger tubes of the heat exchanger can generally be designed in any way.

The heat exchanger tubes are advantageously formed as flat tubes. This leads to a compact formation and a reduced flow resistance for the fluid, which flows around the heat exchanger tubes, thus in particular for the gas. Due to the reduced mechanical stress on the heat exchanger tubes, the heat exchanger tubes, which are formed as flat tubes, are simultaneously preserved mechanically in an effective manner.

The heat exchanger, in particular the condenser or the heat pump heater, respectively, can generally be used in any applications.

The heat exchanger is advantageously used in a cooling circuit, in which the refrigerant circulates along the refrigerant path. The cooling circuit can thereby be part of an air-conditioning system.

The heat exchanger is thereby advantageously arranged on the pressure side in the cooling circuit, so that the refrigerant condenses in the heat exchanger during operation.

The air-conditioning system can generally be used in any applications.

The air-conditioning system and/or the heat exchanger is in particular used in a motor vehicle, in order to air-condition, for example, an interior of the motor vehicle.

The heat exchanger can thereby be used to heat the interior. The gas path leads from the heat exchanger into the interior for this purpose.

It goes without saying that, in addition to the collecting tank and the heat exchanger, the air-conditioning system and the motor vehicle as such also belong to the scope of this invention.

Further important features and advantages of the invention follow from the subclaims, from the drawings, and from the corresponding figure description on the basis of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the following description, whereby identical reference numerals refer to identical or similar or functionally identical components.

BRIEF DESCRIPTION OF THE DRAWINGS

In each case schematically.

DETAILED DESCRIPTION

Figure 1:
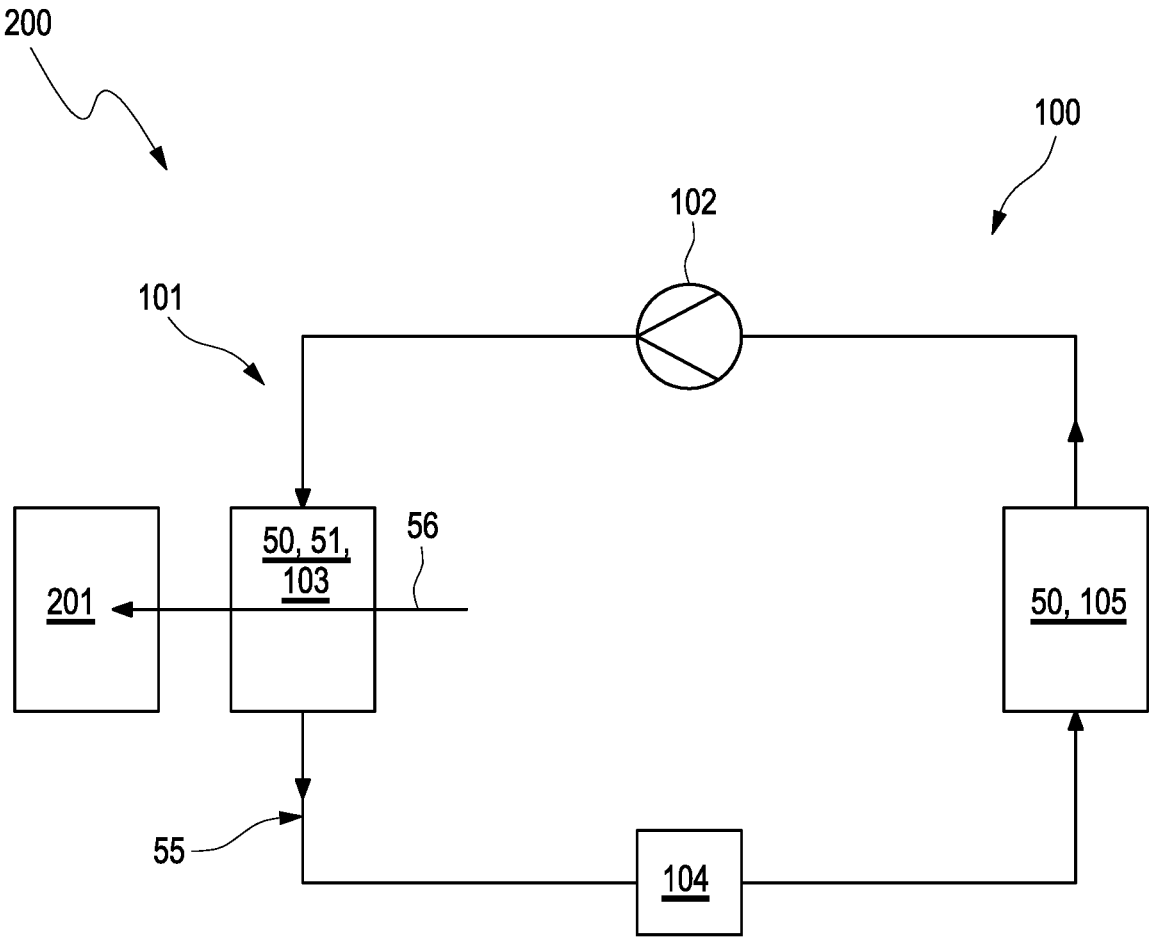
FIG. 1 shows a strongly simplified, circuit diagram-like illustration of an air-conditioning system comprising a heat exchanger in a motor vehicle.
Figure 2:
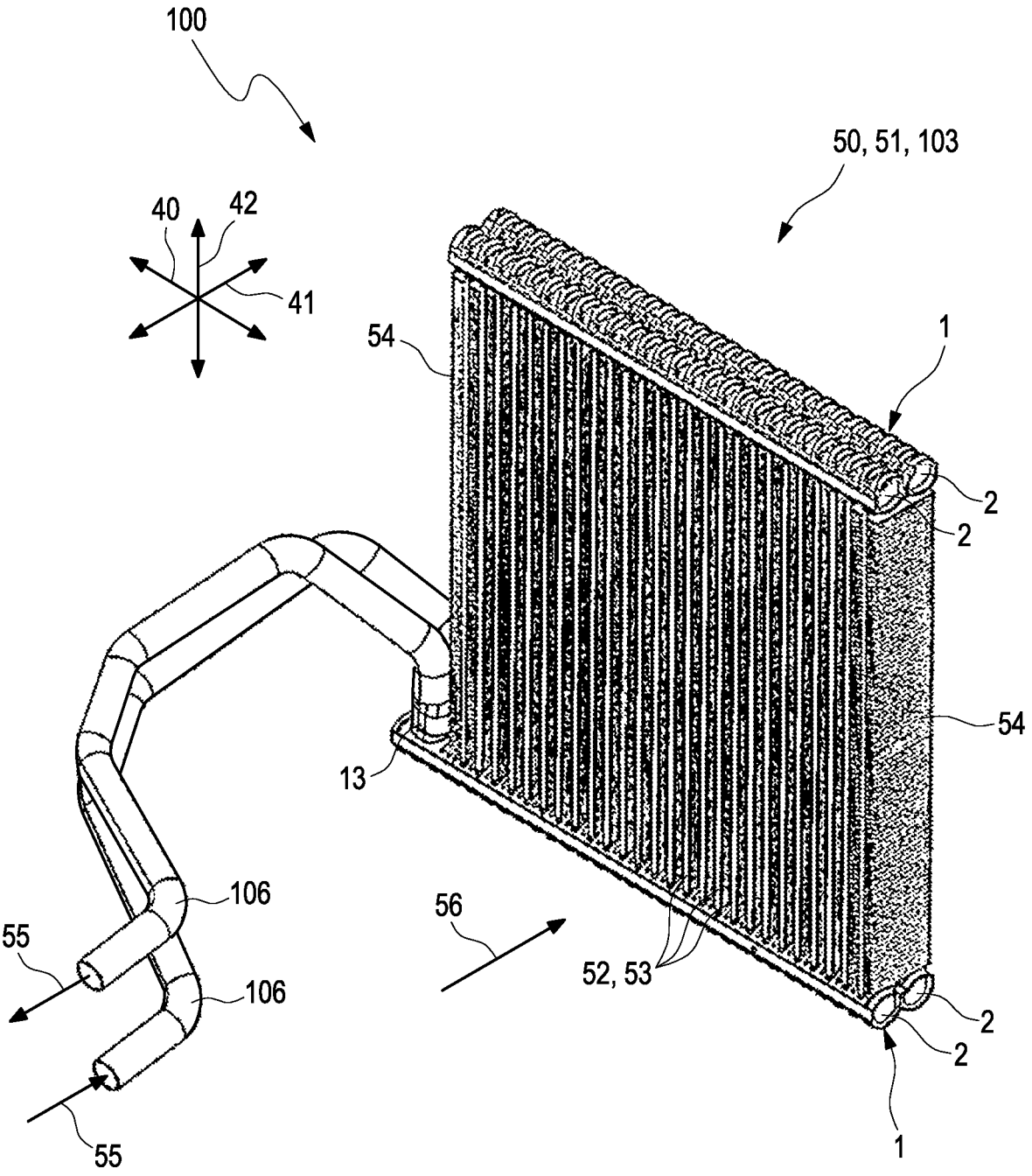
FIG. 2 shows an isometric view of the heat exchanger comprising a collecting tank.

A collecting tank 1, as it is shown in an exemplary manner in FIGS. 2 to 6, is used in a heat exchanger 50, as it is shown in an exemplary manner in FIGS. 1 to 6. The heat exchanger 50 is used in particular in an air-conditioning system 100, which is illustrated in an exemplary manner in FIG. 1. The heat exchanger 50 as well as the air-conditioning system 100 can be used in a motor vehicle 200, which is shown in a highly simplified manner in FIG. 1. The heat exchanger 50 can be designed as a heat pump heater 51, which heats a gas, in particular air, during operation. The heated gas can be fed to an interior 201 of the motor vehicle 200.

As can be gathered from FIG. 1, the air-conditioning system 100 has a cooling circuit 101, through which a refrigerant circulates along a flow path 55 during operation and which will also be referred to hereinafter as refrigerant path 55. The heat exchanger 50 is integrated in the cooling circuit 101, so that the refrigerant path 55 leads through the heat exchanger 50. The air-conditioning system 100 further has a conveying device 102 for driving the refrigerant, so that the refrigerant circulates in the cooling circuit during operation. The refrigerant thereby consecutively flows through at least one condenser 103, an expander 104, as well as a heat exchanger 50, which is operated for evaporating purposes in heating mode, hereinafter simply referred to as evaporator 105. The condenser 103 and the evaporator 105 thereby in each case act as a heat exchanger 50. The heat exchanger 50, which acts as heat pump heater 51, is arranged on the pressure side in the cooling circuit 101, and the condenser 103 in the cooling circuit 101. This means that the refrigerant condenses and/or cools down in the heat pump heater 51 during heating operation. In the cooling mode, the refrigerant is guided through the heat pump heater 51 as overheated steam without flowing through the heat pump heater 51 on the gas side, and is condensed in a condenser (not shown), which is arranged downstream along the refrigerant path 55. In a further possible embodiment, the heat pump heater 51 is not flown through on the refrigerant side in the cooling mode. A flow-through on the gas side can be present in this case.

As can be gathered from FIGS. 2 to 6, the heat exchanger 50 in the shown exemplary embodiment has two such collecting tanks 1. In the shown exemplary embodiments, the collecting tanks 1 are formed essentially identically. In the shown exemplary embodiment, the essential difference between the collecting tanks 1 is that the supply of the heat exchanger 50 with the refrigerant takes place via one of the collecting tanks 1. For this purpose, this collecting tank 1 has two fluidic connections 13, by means of which the tube bodies 106 are fluidically connected to the air-conditioning system 100. The collecting tank 1 having the fluidic connections 13 will be discussed below, whereby it is clear that in the shown exemplary embodiment, the outer geometry of the other collecting tank 1 corresponds to this collecting tank 1, with the exception of the fluidic connections 13. The inner setup of the collecting tanks 1 can differ, for example, by separating walls, other constrictions on the refrigerant side, and passage openings (not shown in each case) between the heat exchanger tubes 52.

According to FIGS. 2 to 6, the collecting tank 1 has at least one manifold 2 for receiving heat exchanger tubes 52 of the heat exchanger 50. In the shown exemplary embodiment, the respective collecting tank 1 has two such manifolds 2. The respective at least one manifold 2 has a hollow space 3, which can be flown through (see FIG. 6), through which the refrigerant flows during operation. This means that the refrigerant path 55 leads through the hollow spaces 3 of the manifolds 2. The respective manifold 2 has a bottom 5, in which receptacles 6 are formed, which are spaced apart from one another in a longitudinal direction 40 and which extend in a transverse direction 41, which extends transverse to the longitudinal direction 40, for receiving the heat exchanger tubes 52. These receptacles 6 will also be referred to hereinafter as tank receptacles 6.

The heat exchanger tubes 52, which are received in the tank receptacles 6, are thus fluidically connected to the hollow spaces 3, so that the refrigerant leads through the heat exchanger tubes 52 during operation. This means that the refrigerant path 55 leads through the heat exchanger tubes 52. A wall 4 of the corresponding manifold 2, which limits the hollow space 3 of the manifold 2, which can be flown through, by means of the bottom 5, adjoins on the respective bottom 5. The manifolds 2 of the collecting tank 1 are further adjacent in the transverse direction 41. In the shown exemplary embodiment, the tank receptacles 6 are formed by means of passages 12, which are directed away from the corresponding hollow space 3.

Figure 3:
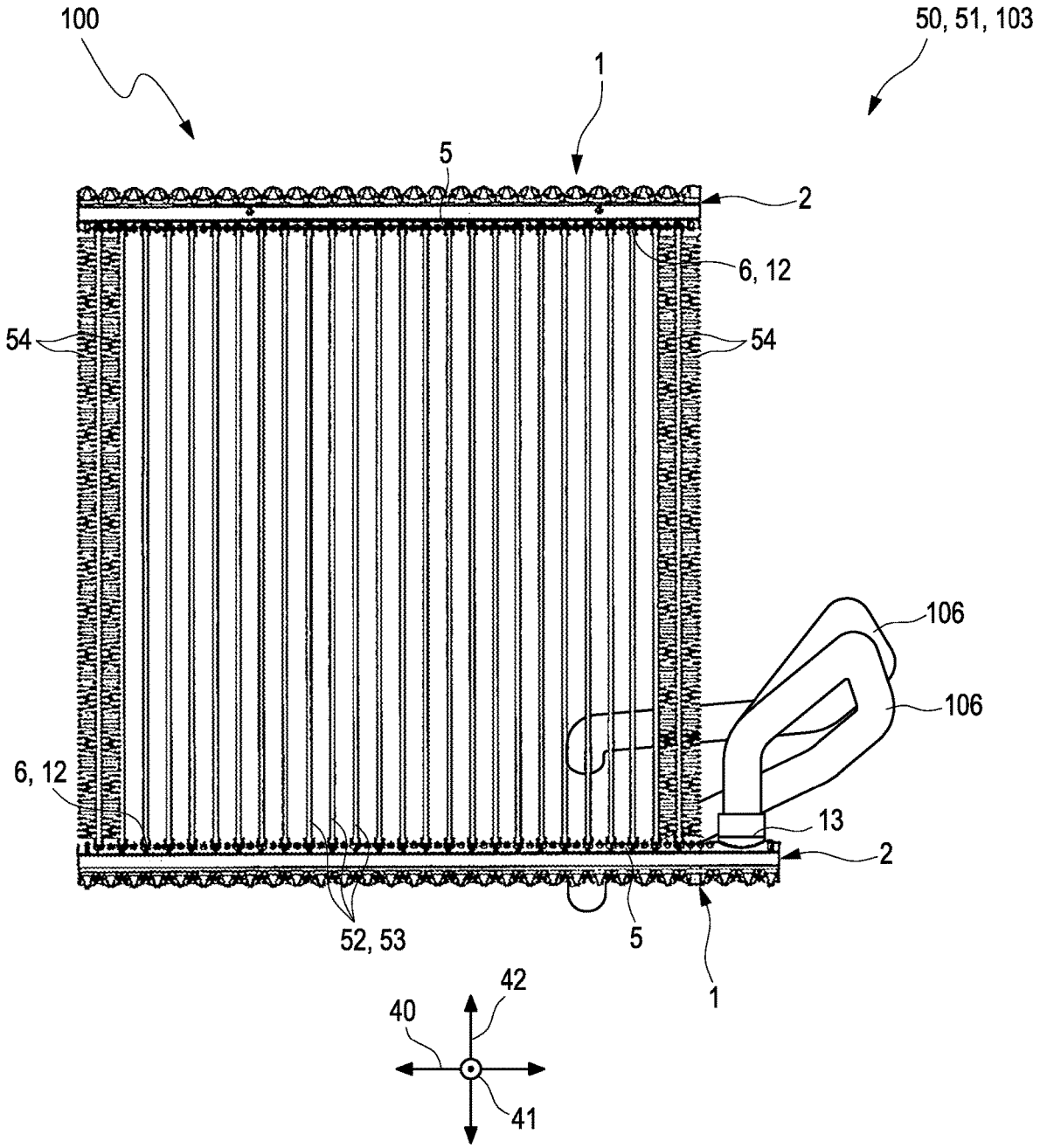
FIG. 3 shows a side view of the heat exchanger in a transverse direction.
Figure 4:
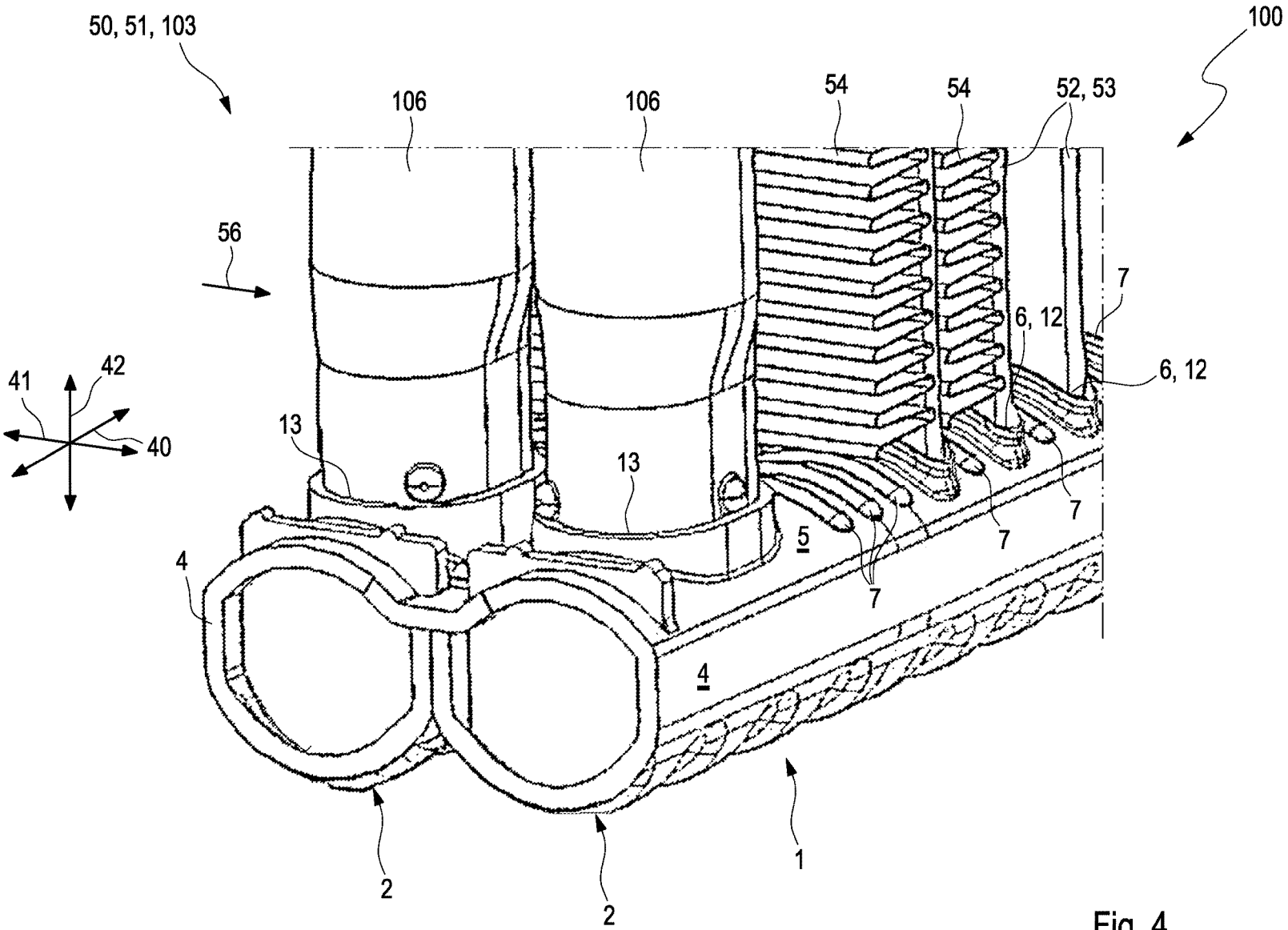
FIG. 4 shows an isometric view of the heat exchanger in the region of the collecting tank.
Figure 5:
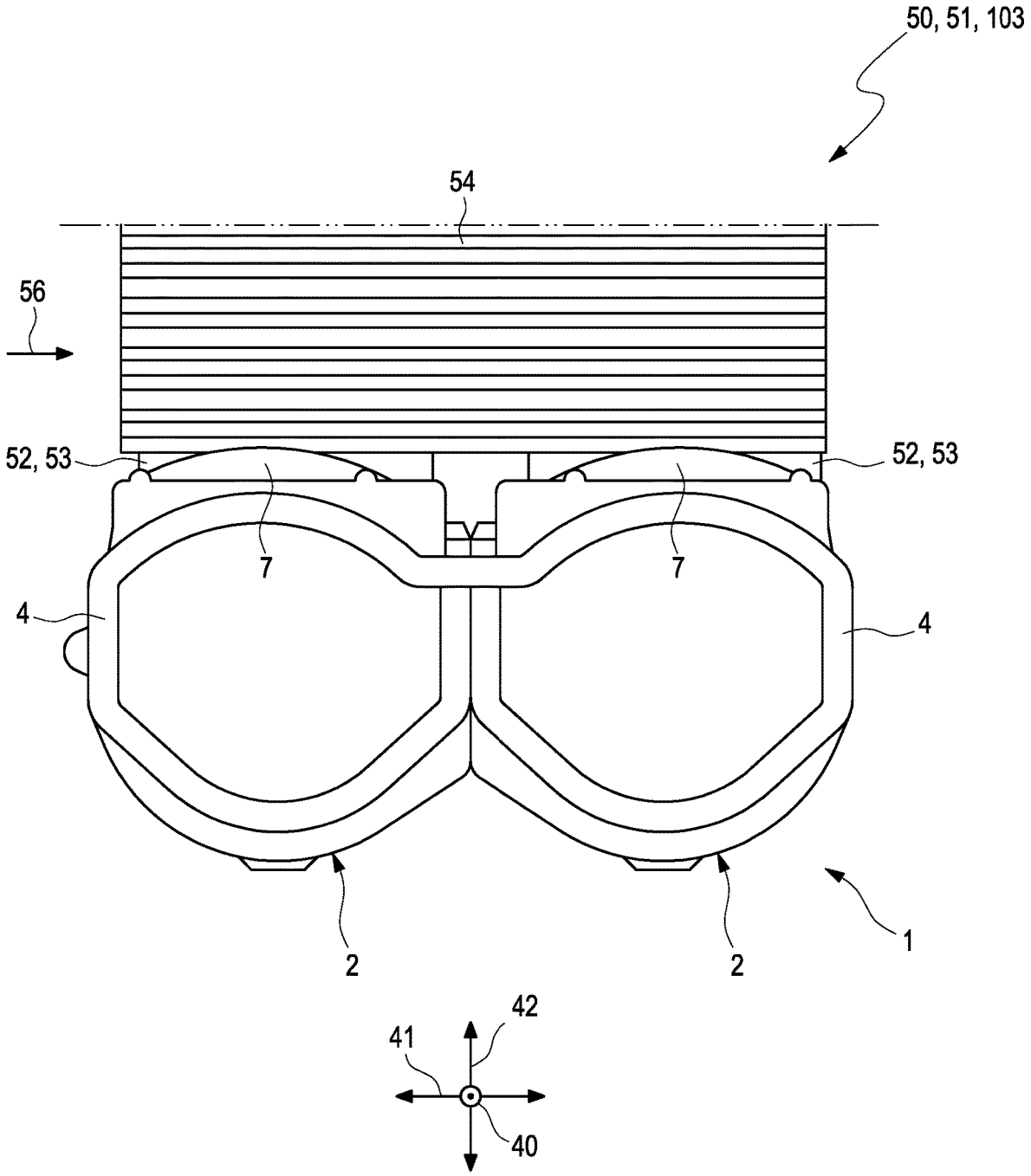
FIG. 5 shows a side view of the heat exchanger in the region of the collecting tank and in a longitudinal direction.
Figure 6:
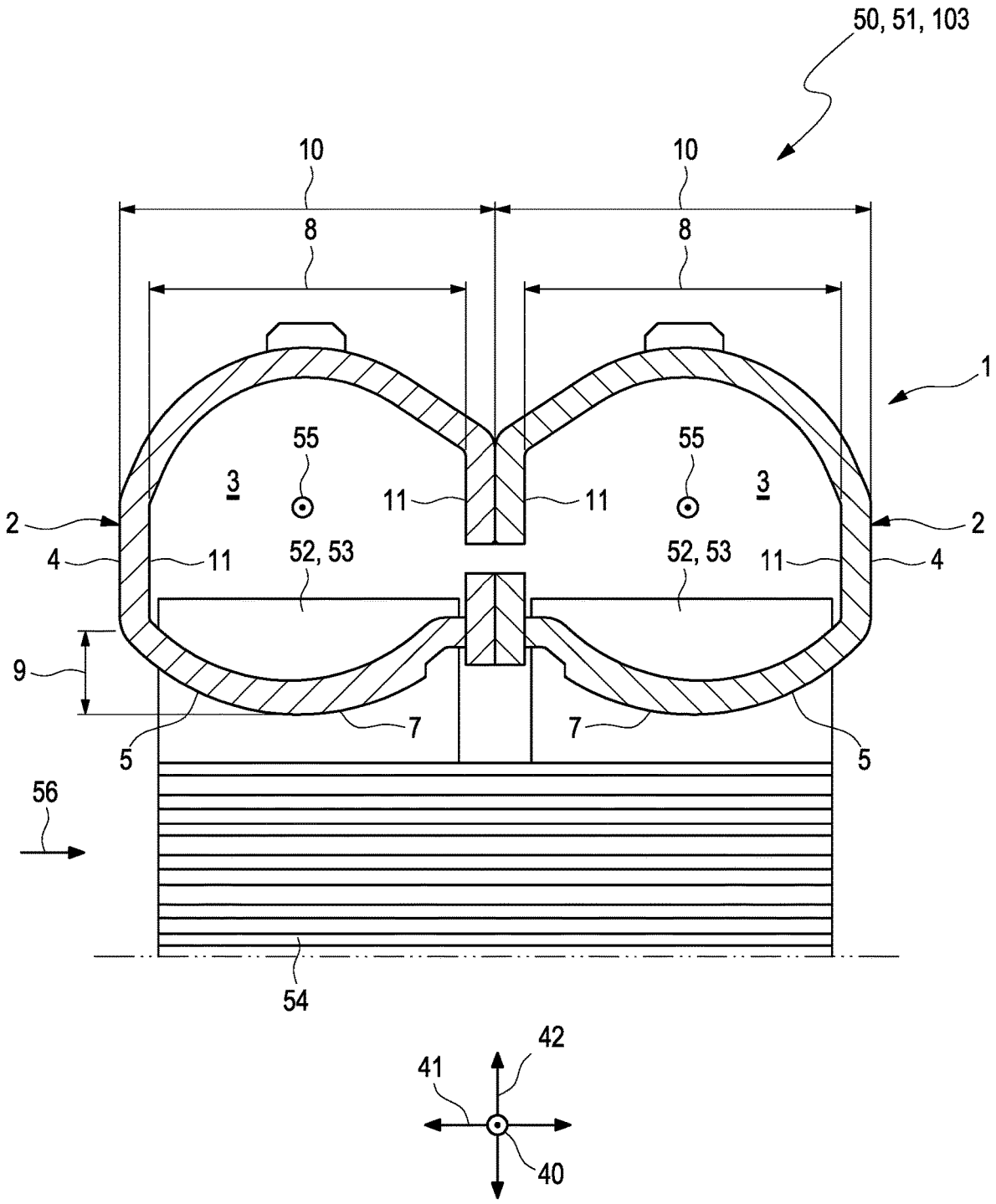
FIG. 6 shows a section through the heat exchanger in the region of the collecting tank.

As can be gathered in particular from FIGS. 4 to 6, the bottom 5 has at least one curvature 7, which is directed to the outside and thus away from the hollow space 3 in a height direction 42, which runs transverse to the longitudinal direction 40 and transverse to the transverse direction 41. As can be gathered from FIGS. 4 to 6, the respective bottom 5 in the shown exemplary embodiment has at least two such curvatures 7, which are spaced apart from one another in the longitudinal direction 40. As can likewise be gathered from these figures, one such curvature 7 is in each case arranged between consecutive tank receptacles 6 in the shown exemplary embodiment. The curvatures 7 thereby extend longitudinally in the transverse direction 41 and thus run parallel to the tank receptacles 6. As can further be gathered in particular from FIG. 4, at least one such curvature 7 is likewise further formed between the connections 13 and the nearest adjacent tank receptacle 6 in the longitudinal direction 40 in the case of the collecting tank 1 having the fluidic connections 13. In the shown exemplary embodiment, three curvatures 7 are arranged in a purely exemplary manner between the connections 13 and the tank receptacle 6 nearest adjacent in the longitudinal direction 40. It would also be conceivable that the bottom 5 as a whole has one such curvature 7, is thus curved completely to the outside (not shown). As can be gathered from FIGS. 2 and 3, the collecting tanks 1 are thereby arranged opposite one another in the height direction 42, so that the bottoms 5 face one another in the height direction 42. In the shown exemplary embodiments, the bottom 5 has a basic shape, which is curved to the outside, in the height direction 42 and into which the curvature 7 is introduced additionally and locally.

As can be gathered from FIG. 6, the respective tank receptacle 6 extends in the transverse direction 41 over a width 8, which will also be referred to hereinafter as receiving width 8. As can further be gathered from FIG. 6, the respective curvature 7 has a height 9, which runs in the height direction 42 and which will also be referred to hereinafter as curvature height 9. The curvature height 9 thereby extends from the point of the curvature 7, which protrudes maximally in the height direction 42, and the point, which is nearest adjacent in the height direction 42 of the curvature 7 and in the case of which the corresponding manifold 2 has a maximum width 10 in the transverse direction 41. The width 10 of the manifold 2 will also be referred to hereinafter as manifold width 10. In the shown exemplary embodiments, the maximum manifold width 10 is present on the outer side of the wall 4 facing away from the hollow space 3 in the transition region of the wall 4 to the bottom 5. The curvature height 9 thus runs between outer sides of the corresponding manifold 2, which face away from the hollow space 3. The receiving width 8 further extends between inner sides 11, which face one another in the transverse direction 41.

In the shown exemplary embodiments of the respective curvature height 9 and of the respective receiving width 8, the ratio between at least one of the at least one curvature heights 9 and at least one of the receiving widths 8 of at least one of the at least one manifolds 2 is thereby between 0.05 and 1.5. In the shown exemplary embodiment, the ratio between at least one of the at least one curvature heights 9 and at least one of the receiving widths 8 of at least one of the at least one manifolds 2, in the shown exemplary embodiment of the respective curvature height 9 and of the respective receiving width 8, is between 0.10 and 0.5.

As can be gathered in particular from FIG. 1, a flow path of the gas 56, hereinafter also referred to as gas path 56, leads through the heat exchanger 50, which is formed as heat pump heater 52 and which is fluidically separated from the refrigerant path 55, so that heat is transferred between the refrigerant and the gas during operation. The gas, in particular the air, is heated thereby and can then, as described above, be fed to the interior 201. This further leads to a condensation of the refrigerant, which flows through the heat exchanger 50.

As can be gathered in particular from FIG. 3, the heat exchanger tubes 52 are formed as flat tubes 53 in the shown exemplary embodiment. The gas path 56 thereby leads between the heat exchanger tubes 52. As can further be gathered in particular from FIGS. 2 and 4, corrugated fins 54, which can be flown through, are provided between adjacent heat exchanger tubes 52 in the shown exemplary embodiment. They lead to an increase of the heat-transferring surface and thus to an improved heat transfer between the gas and the refrigerant. For the sake of clarity, the corrugated fins 54 are shown only on the outer heat exchanger tubes 52 in the longitudinal direction 40 in FIGS. 2 to 4.

The collecting tank 1 according to the invention has an increased mechanical stability, in particular an increased pressure resistance. The same applies for the heat exchanger 50, together with heat exchanger tubes 52, in particular flat tubes 53.

The invention claimed is:

1. A collecting tank for a heat exchanger, comprising:

at least one manifold for receiving a plurality of heat exchanger tubes of the heat exchanger;

the at least one manifold having a hollow space through which a fluid is flowable;

the at least one manifold including a bottom and a plurality of tank receptacles for receiving the plurality of heat exchanger tubes, the plurality of tank receptacles disposed in the bottom spaced apart from one another in a longitudinal direction and extending in a transverse direction, which extends transverse to the longitudinal direction;

wherein, in a height direction extending transverse to the longitudinal direction and transverse to the transverse direction, directed away from the hollow space, the bottom has at least one curvature directed to an outside;

wherein, in the transverse direction, the plurality of tank receptacles each extend over a receiving width;

wherein the at least one curvature has a curvature height extending between a first point of the at least one curvature, which protrudes maximally in the height direction, and a second point, which is nearest to the first point of the at least one curvature in the height direction, at which the at least one manifold has a maximum manifold width in the transverse direction;

wherein the at least one curvature protrudes from the bottom and extends completely across the bottom in the transverse direction; and wherein a ratio between the curvature height and the receiving width is 0.05 to 1.5.

2. The collecting tank according to claim 1, wherein the bottom has a convex shape, which is curved to the outside in the height direction and into which the at least one curvature is introduced additionally and locally.

3. The collecting tank according to claim 1, wherein the ratio between the curvature height and the receiving width is 0.10 to 0.5.

4. The collecting tank according to claim 1, wherein the receiving width of a tank receptacle of the plurality of tank receptacles extends between two inner sides of the tank receptacle facing one another in the transverse direction.

5. The collecting tank according to claim 1, wherein the bottom fully has the at least one curvature.

6. The collecting tank according to claim 1, wherein the at least one curvature is disposed between at least two tank receptacles, which are disposed consecutively in the longitudinal direction, of the plurality of tank receptacles.

7. The collecting tank according to claim 1, wherein:

the at least one manifold includes two manifolds disposed adjacent to one another in the transverse direction; and each of the two manifolds includes the at least one curvature.

8. A heat exchanger, comprising a collecting tank according to claim 1 and at least two heat exchanger tubes received in the plurality of tank receptacles, wherein:

a refrigerant path of a refrigerant extends through the collecting tank and through the at least two heat exchanger tubes; and a gas path of a gas extends between the at least two heat exchanger tubes and is fluidically separated from the refrigerant path such that heat is transferred between the refrigerant and the gas during operation.

9. An air-conditioning system, comprising:

a cooling circuit through which a refrigerant circulates along a flow path during operation; and a heat exchanger according to claim 8 through which the refrigerant path extends.

10. The air-conditioning system according to claim 9, wherein the heat exchanger is arranged on a pressure side in the cooling circuit such that the refrigerant condenses in the heat exchanger during operation.

11. A motor vehicle, comprising a heat exchanger according to claim 8, wherein the gas path extends into an interior of the motor vehicle.

12. The collecting tank according to claim 1, wherein:

the at least one manifold further includes a wall adjoining the bottom such that the wall and the bottom define the hollow space;

the wall includes a circle-segment portion disposed opposite the bottom, a first transition portion, and a second transition portion disposed opposite the first transition portion;

the first transition portion and the second transition portion extend between and connect the circle-segment portion and the bottom;

the maximum manifold width is defined by and between a first external surface of the first transition portion and a second external surface of the second transition portion; and the receiving width is defined by and between a first internal surface of the first transition portion and a second internal surface of the second transition portion.

13. The collecting tank according to claim 12, wherein the bottom and the wall are integrally connected to one another such that the at least one manifold is a monolithic component.

14. The collecting tank according to claim 12, wherein, in a region of the at least one curvature, the bottom has a thickness that is greater than a thickness of the wall.

15. The collecting tank according to claim 1, wherein the at least one curvature is a solid body projecting from the bottom.

16. A collecting tank for a heat exchanger, comprising:

at least one manifold extending in a longitudinal direction;

the at least one manifold including a bottom, a plurality of tank receptacles for receiving a plurality of heat exchanger tubes, and a hollow space through which a fluid is flowable;

the plurality of tank receptacles disposed in the bottom and arranged spaced apart from one another in the longitudinal direction;

the plurality of tank receptacles extending in a transverse direction, which extends transverse to the longitudinal direction;

wherein the bottom includes at least one outwardly directed curvature protruding away from the hollow space in a height direction extending transverse to the longitudinal direction and transverse to the transverse direction;

wherein the at least one curvature extends completely across the bottom in the transverse direction;

wherein the at least one manifold is integral; and wherein the at least one curvature is a solid protrusion projecting from the bottom.

17. The collecting tank according to claim 16, wherein the at least one curvature encompasses an entirety of the bottom such that the entire bottom is outwardly curved.

18. The collecting tank according to claim 16, wherein:

the at least one manifold further includes a wall adjoining the bottom such that the wall and the bottom define the hollow space; and the wall includes a circle-segment portion disposed opposite the bottom and two transition portions that extend between and connect the circle-segment portion and the bottom.

19. The collecting tank according to claim 18, wherein:

the plurality of tank receptacles each have a receiving width extending in the transverse direction;

the at least one curvature has a curvature height extending between a peak of the at least one curvature and a point that is aligned with the peak in the height direction and that is aligned with a transition between the bottom and the wall in the transverse direction; and a ratio between the curvature height and the receiving width is 0.05 to 1.5.

20. A collecting tank for a heat exchanger, comprising at least one manifold extending in a longitudinal direction, wherein:

the at least one manifold includes:

a bottom;

a wall adjoining the bottom such that the wall and the bottom define a hollow space through which a fluid is flowable; and a plurality of tank receptacles for receiving a plurality of heat exchanger tubes, the plurality of tank receptacles disposed in the bottom and arranged spaced apart from one another in the longitudinal direction;

the plurality of tank receptacles extend in a transverse direction, which extends transverse to the longitudinal direction;

the bottom includes an outwardly directed curvature protruding from the bottom away from the hollow space in a height direction extending transverse to the longitudinal direction and transverse to the transverse direction; and the at least one curvature extends completely across the bottom in the transverse direction.

* * * * *